US005769145A

United States Patent [19]

Kwatonowski

[11] Patent Number: 5,769,145

[45] Date of Patent: Jun. 23, 1998

[54] ADJUSTABLE MEANS FOR OPENING A DOOR LATCH

[76] Inventor: Frank Kwatonowski, 5 Lamington Rd., Whitehouse, N.J. 08888-0427

[21] Appl. No.: 828,570

[22] Filed: Mar. 31, 1997

[51] Int. Cl.[6] ..... A47G 5/00

[52] U.S. Cl. ..... 160/371; 49/141; 292/347

[58] Field of Search ..... 160/371, 369; 16/402, DIG. 5, 111 R, 112, 115; 70/DIG. 64; 292/339, 347, DIG. 2; 49/394, 141

[56] References Cited

U.S. PATENT DOCUMENTS

| | | | |
|---|---|---|---|
| 1,860,780 | 5/1932 | Kees | 16/402 |
| 2,225,211 | 12/1940 | Erickson | 16/402 |
| 2,261,652 | 11/1941 | Mere | 16/DIG. 5 X |
| 2,582,526 | 1/1952 | Burdick | 16/DIG. 5 X |
| 2,870,493 | 1/1959 | Beyrle | 16/111 R X |
| 2,931,078 | 4/1960 | Beyrle | 16/111 R X |
| 3,919,807 | 11/1975 | Mefford | 49/394 X |
| 4,084,845 | 4/1978 | Eckert | 292/DIG. 2 X |
| 4,085,877 | 4/1978 | Hildebrand | 16/111 R X |
| 5,425,155 | 6/1995 | Marciniak | 16/112 |
| 5,447,346 | 9/1995 | Virzi | 292/289 |

*Primary Examiner*—David M. Purol
*Attorney, Agent, or Firm*—Thomas A. Beck

[57] ABSTRACT

An assembly for opening a door latch used in combination with a door, wherein the assembly includes a push-bar with an end piece that envelopes the door latch, the end piece being integrally connected to the bar at one of its ends and, connected at the other end to a spring which holds the assembly outward and away from the door, the other end of the spring is fastened to the door.

12 Claims, 2 Drawing Sheets

ADJUSTABLE MEANS FOR OPENING A DOOR LATCH

BACKGROUND OF THE INVENTION

1. Technical Field of the Invention

The present invention relates generally to an installed assembly including a bar which extends generally horizontally across the width of a door and which, at one end thereof, is interconnected with the latch on the door to allow unlatching and opening of the door by application of pressure at any location along the bar using any part of the body.

2. Description of the Related Art

U.S. Pat. 3,827,183 discloses a center hung pivot door assembly wherein the door is mounted on a frame in such a way as to prevent human fingers, feet, etc from being caught in between the door and the frame. The reference also discloses push bars on both horizontal sides of the door including means by which a lock cylinder is fully recessed so that its exposed face is flush with the surface of the push bar, or with a shield plate surrounding the recessed pull, thereby to reduce the possibility that the lock cylinder can be removed to force an entry. The reference teaches that the push bar is an integral part of the construction of the door. Thus it is not portable as is the assembly of the present invention.

U.S. Pat. No. 2,225,211 discloses a horizontal push bar attached to both stiles of a door which is used to push open a door and serves to carry advertisements thereon. The ends of the bars are secured to the door. One end thereof is not secured to the latch which controls the open and closing of the door as is the case in the present invention.

U.S. Pat. No. 1,860,780 discloses a guard especially designed for use on doors, windows, which can be secured in position so a person may grip or push against the guard on opening or closing the door, thereby protecting the wire mesh or material on the door. This guard is not secured to the latch so differs from the assembly of the present invention which is secured to the latch.

Many doors used as screen doors or storm doors and others, possess only a small latch at the lock stile. This results in difficulty if a person egressing from a room, building etc., is unable to manipulate the latch for any reason. Handicapped individuals in some cases may have difficulty using the manual dexterity necessary to turn or push a latch on a door. This hardship is eliminated using the assembly of the present invention since all that is needed is a push along any length of the bar to open the door.

Other objects and features as well as additional details of the present invention will become apparent from the following detailed description and annexed drawings of the presently preferred embodiments thereof, when considered in conjunction with the associated drawings.

SUMMARY OF THE INVENTION

The present invention relates to an installed assembly including a bar which extending horizontally across the width of a door and which, at one end thereof, is interconnected with the latch on the door to allow unlatching and opening of the door by application of pressure at any location along the bar using any part of the body. Because any part of the body can be used to actuate the assembly of the present invention is conveniently referred to as a "body latch."

The assembly of the present invention comprises a main bar piece, which may or may not be adjustable, having an adapter piece at the latch end thereof and a flat spring at the other end thereof. The end having the flat spring is attached to the door, generally the pivot stile of the door. Unlike the prior art disclosed above, the latch end of the assembly is not fixedly attached to the lock stile, but rather is interconnected to the latch. When the installed assembly is in place, the door can be opened easily by applying light pressure anywhere along the length of the bar.

The object is to enable a door to be opened easily without assistance if the arms or hands are full of bundles, glasses of liquids, etc.

The assembly can be installed easily by slipping the adapter end of the bar over the door push or rotatable latch lever, and attaching the other end of the bar having the flat spring to the pivot stile using any suitable fixing means. In an alternate embodiment, the bar can possess a telescoping feature so when installing the unit, the bar is expanded out to the proper width and attaching the ends to the door latch lever and pivot stile as described above.

DETAILED DESCRIPTION OF THE PRESENTLY PREFERRED EMBODIMENTS

Figure 1:
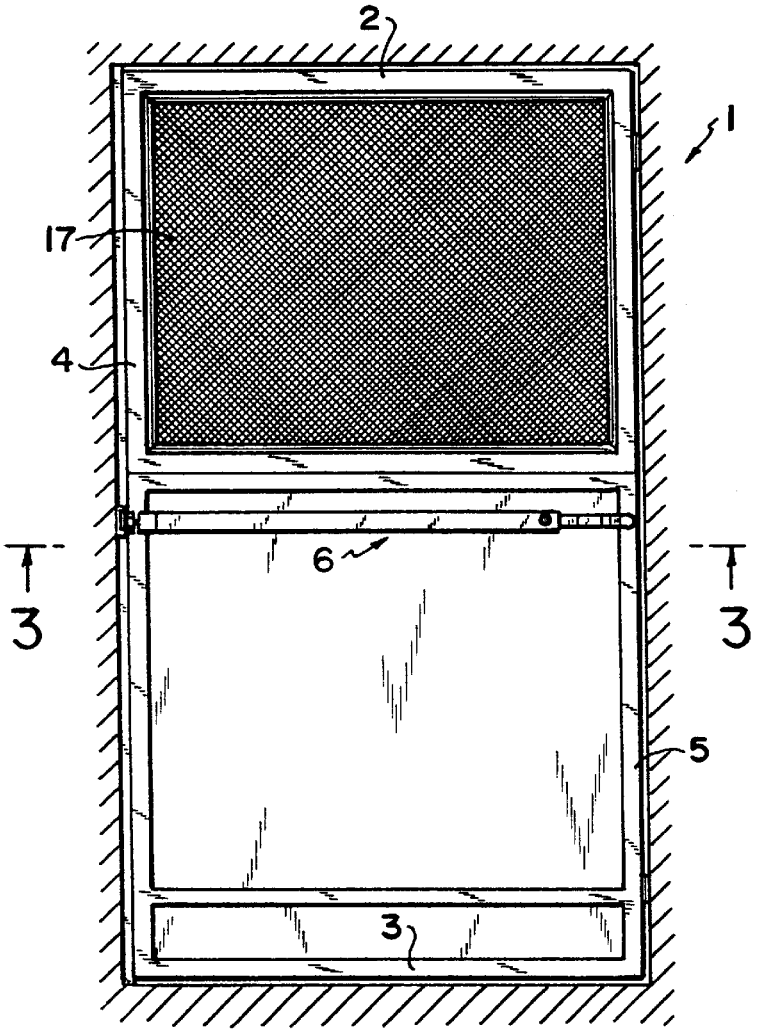
FIG. 1 depicts a door in combination with one embodiment of the assembly of the present invention.

Referring to the drawings, FIG. 1 is an elevation of a screen or storm door 1 having a parallel top rail 2 and bottom rail 3 secured to a pivot stile 4 and lock stile 5. Attached to and spanning substantially parallel stiles 4 and 5 is the push-bar assembly of the present invention 6. The central portion 17 of door 1 encased by top rail 2, bottom rail 3, pivot stile 4 and lock stile 5 is glass, screen, wood, metal, or any other suitable material. The lock on the door may be of the type possesses a handle that is pushed in (i.e. movement in a horizontal plane) toward the door thus pushing the door out while eggressing; or it may be the type wherein the handle rotates around a central pivot point (i.e. an arcuate movement in the vertical plane) so that the handle is rotated down or up to disengage the tip of the locking means from the member secured to the jamb which secures the door in a closed position when the handle is at rest in its normal horizontal position. The present invention is designed to be used with both types of door fasteners.

Figure 2:
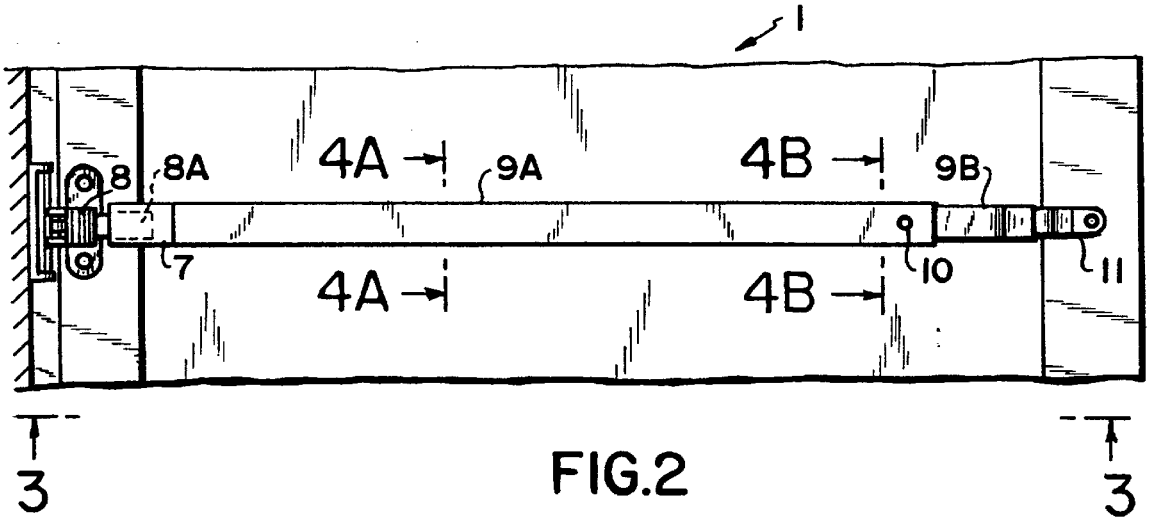
FIG. 2 is an enlarged front view of the assembly taken along A—A in FIG. 1.

Referring to FIG. 2, is a enlarged view of assembly 6 comprising end piece 7 that envelopes door latch 8. End piece 7 may be of varying dimensions to correspond in general with the configuration of door latch 8. End piece 7 is integrally connected to hollow or solid bar 9 [See FIG. 4] which can be rectangular, round or oval in cross section. In a preferred embodiment shown in FIG. 2, bar 9 comprises two sections 9A and 9B to accommodate the width of the door. Section 9B telescopes within the interior of section 9A. Bar 9 is expanded to fit the dimensions of the door and section 9A is secured to section 9B by any suitable fixing means 10 such as sheet metal screw, pop rivet, etc. The end of bar section 9B that is not within section 9A is secured to flat spring 11 which holds the bar assembly outward and away from door 1. Alternatively, in another preferred embodiment, as described above, the bar 9 can be a solid single piece if it is the proper width to match the width of the door.

The section of flat spring 11 not secured to bar section 9B is fastened to pivot stile 4. Flat spring 11 can be of any suitable material which can withstand the constant flexing associated with opening and closing the door. Preferably a tempered resilient flexible steel is used, however other materials may be used. In the event a rotatable door handle is used on the door, the spring will be rotatably mounted on the pivot stile to move up and down in a vertical plane. Any convenient arrangement to achieve the movable function can be used.

Although one embodiment of the present invention contemplates that bar 9 comprises telescoping sections 9A and 9B, if the dimensions of the door are known in advance, a single bar comprising wood or any other suitable material can be used.

Figure 3:
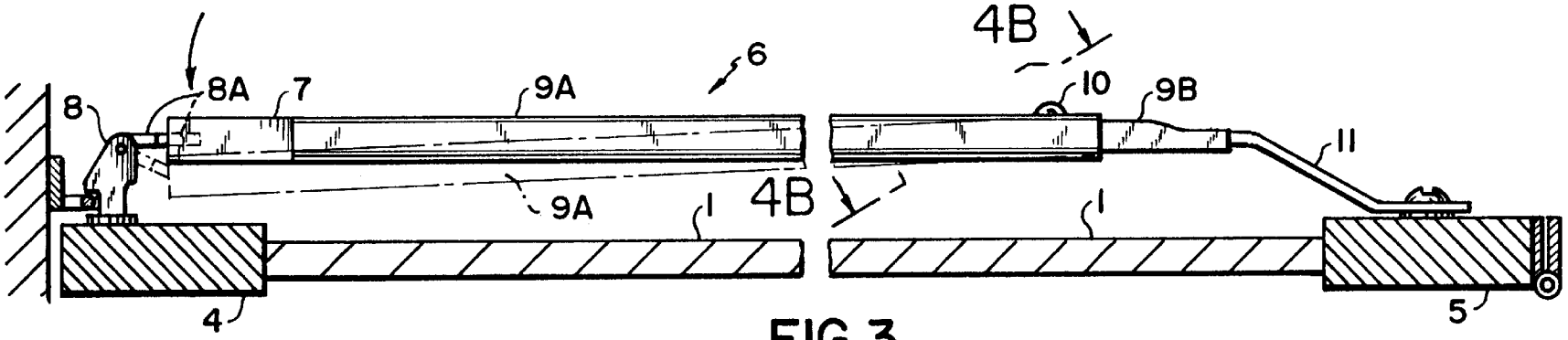
FIG. 3 is an enlarged bottom view of the assembly taken along B—B in FIG. 2.

Referring to FIG. 3, the telescoping embodiment of the invention is depicted. The existing door latch 8 has the tip of its handle [shown with broken lines 8A] encased within end piece 7. End piece 7 corresponds in general with the configuration of door latch 8. End piece 7 is integrally connected to hollow section 9A which rectangular in cross section. Section 9B is telescoped within the interior of section 9A. Bar 9 has been expanded to fit the dimensions of the door. Section 9A is secured to section 9B by a sheet metal screw 10, but as noted above other suitable fixing means can be used. The end of bar section 9B that is not within section 9A is secured to flat spring 11 which holds the bar assembly outward and away from door 1. The section of flat spring 11 not secured to bar section 9B is fastened to pivot stile 4 again using a sheet metal screw secured to the pivot stile.

Figure 4B:
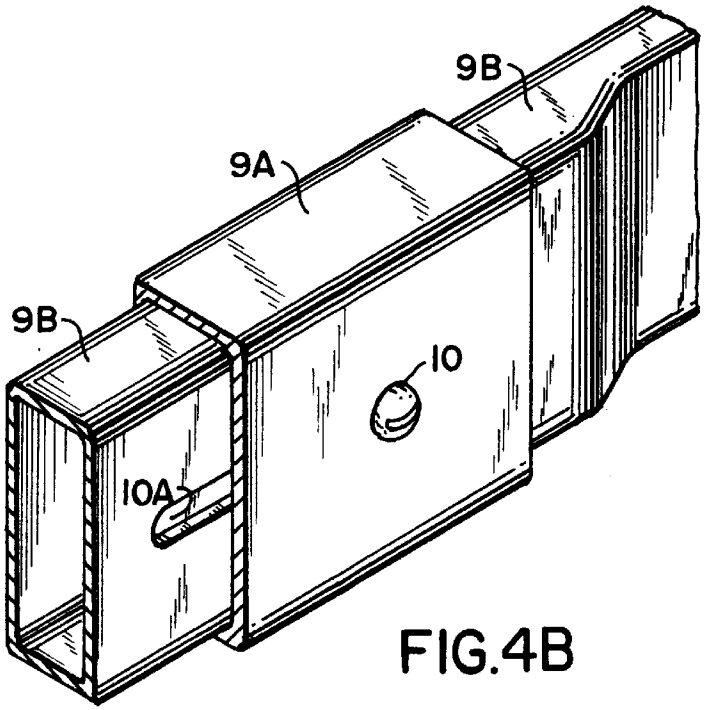
FIG. 4B is a cross sectional view of the bar taken along D—D in FIG. 2.
Figure 4A:
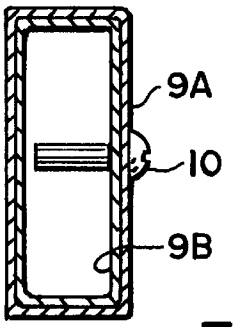
FIG. 4A is a cross sectional view of the bar taken along C—C in FIG. 2.

FIG. 4A depicts the cross section of bar section 9A taken along C—C of FIG. 2. FIG. 4B depicts the cross section of bar section 9B taken along D—D of FIG. 2 showing cross sections of both 9A and 9B.

The device of the present invention is made from a metal or any inert natural or synthetic material which can be formed into the desired shape.

The invention is not limited by the embodiments described above which are presented as examples only, but can be modified in various ways within the scope of protection defined by the appended patent claims.

Thus, while there have been shown and described and pointed out fundamental novel features of the invention as applied to currently preferred embodiments thereof, it will be understood that various omissions and substitutions and changes in the form and details of the method and apparatus illustrated, and in their operation, may be made by those skilled in the art without departing from the spirit of the invention. In addition it is to be understood that the drawings are not necessarily drawn to scale but that they are merely conceptual in nature. It is the intention, therefore, to be limited only as indicated by the scope of the claims appended herewith.

I claim:

1. An assembly for opening a door latch used in combination with a door, said door comprising a top rail, a bottom rail each substantially parallel to each other and secured to a pivot stile and a lock stile each substantially parallel to the other, a central portion of said door encased by said top rail, said bottom rail, said pivot stile and said lock stile, said door also having mechanical fastening means situated on said lock stile which cooperates;

said assembly comprising a push-bar having a fulcrum end and a lock end attached respectively to said pivot stile and said lock stile of said door and spanning the distance between said pivot stile and said lock stile;

said lock end of said push-bar comprising an end piece that envelopes said mechanical fastening means;

said end piece being integrally connected to a connecting bar at a first end of said bar, said connecting bar having a second end secured to a lock end, said lock end being fastened to a first end of positioning means which maintains said assembly in a spaced relationship away from said door, said positioning means also having a second end which is fastened to said pivot stile.

2. The assembly defined in claim 1 wherein said positioning means is a flexible sheet spring capable of flexing outwardly when said door is opened.

3. The assembly defined in claim 1 wherein said positioning means is a flexible sheet spring capable of rotating about a fixed axis on said pivot stile when pressure is applied to said assembly to disengage said mechanical fastening means.

4. The assembly defined in claim 1 wherein said bar is hollow and comprises a plurality of sections in which at least one of said sections can telescope within another section.

5. The assembly defined in claim 4 wherein said at least one of the telescoping sections is fastened to another section by fastening means selected from the group consisting of screws and rivets.

6. The assembly defined in claim 5 wherein said connecting bar is rectangular in cross section.

7. The assembly defined in claim 5 wherein said connecting bar is circular in cross section.

8. The assembly defined in claim 5 wherein said connecting bar is oval in cross section.

9. The assembly defined in claim 1 wherein said door is a storm door.

10. The assembly defined in claim 1 wherein said door is a screen door.

11. The assembly defined in claim 5 wherein said bar is solid throughout its cross-section.

12. The assembly defined in claim 1 wherein said assembly is made from a metal, a natural or synthetic material.

* * * * *